US009761383B2

(12) United States Patent
Leach et al.

(10) Patent No.: US 9,761,383 B2
(45) Date of Patent: Sep. 12, 2017

(54) MANUAL TRANSFER SWITCH INTERLOCK DEVICE

(71) Applicant: Milbank Manufacturing Co., Kansas City, MO (US)

(72) Inventors: Douglas Leach, Kansas City, MO (US); Daniel Newmaster, Kansas City, MO (US)

(73) Assignee: MILBRANK MANUFACTURING CO., Kansas City, MO (US)

( * ) Notice: Subject to any disclaimer, the term of this patent is extended or adjusted under 35 U.S.C. 154(b) by 93 days.

(21) Appl. No.: 14/702,172

(22) Filed: May 1, 2015

(65) Prior Publication Data

US 2015/0318123 A1 Nov. 5, 2015

Related U.S. Application Data

(60) Provisional application No. 61/988,026, filed on May 2, 2014.

(51) Int. Cl.
*H01H 9/26* (2006.01)
*H01H 9/02* (2006.01)
*H01H 9/28* (2006.01)

(52) U.S. Cl.
CPC ..... *H01H 9/02* (2013.01); *H01H 9/26* (2013.01); *H01H 9/28* (2013.01)

(58) Field of Classification Search
CPC H01H 9/26; H01H 3/20; H01H 9/223; H01H 9/28; H01H 50/323
USPC ..... 200/50.35, 50.32, 5 B, 5 E, 5 EA, 5 EB, 200/43.14
See application file for complete search history.

(56) References Cited

U.S. PATENT DOCUMENTS

| | | | | |
|---|---|---|---|---|
| RE26,113 | E * | 11/1966 | Carter et al. | H01H 9/26 200/330 |
| 4,665,284 | A * | 5/1987 | Guinan | H01H 9/26 200/50.33 |
| 5,895,981 | A | 4/1999 | Flegel | |
| D425,490 | S | 5/2000 | Flegel | |
| 6,107,701 | A | 8/2000 | Flegel | |
| 6,163,449 | A | 12/2000 | Flegel | |
| 6,293,821 | B1 | 9/2001 | Flegel | |
| 6,365,990 | B2 | 4/2002 | Flegel | |
| 6,414,240 | B1 | 7/2002 | Flegel | |

(Continued)

*Primary Examiner* — Felix O Figueroa
(74) *Attorney, Agent, or Firm* — Polsinelli PC; Joshua J. Pranckun; Derek D. Donahoe

(57) ABSTRACT

A switch interlock device for controlling certain switching operations within a switch panel, the switch interlock device including a bracket and an interlock tripping mechanism. The bracket being configured to be coupled to a housing of the switch panel and comprising a face member coupled with a spanning member extending a depth of the housing, the spanning member operably coupled to a back wall of the housing. The interlock tripping mechanism coupled to the face member of the bracket and positioned between a pair of horizontally adjacent switches housed within the housing of the switch panel, the interlock tripping mechanism configured to: restrict the pair of horizontally adjacent switches from both being in an ON position at the same time; and switch one of the pair of horizontally adjacent switches to an OFF position when the other of the pair of horizontally adjacent switches is switched to the ON position.

18 Claims, 5 Drawing Sheets

(56) References Cited

U.S. PATENT DOCUMENTS

| | | | | |
|---|---|---|---|---|
| 6,504,268 | B1 | 1/2003 | Flegel | |
| 6,534,735 | B1 | 3/2003 | Czarnecki | |
| 6,570,114 | B1 | 5/2003 | Czarnecki | |
| 6,596,956 | B1 | 7/2003 | Czarnecki | |
| 6,600,122 | B1 | 7/2003 | Czarnecki | |
| 6,613,995 | B1 | 9/2003 | Czarnecki | |
| 6,861,596 | B2 | 3/2005 | Schnackenberg | |
| 7,411,139 | B2 * | 8/2008 | McCoy | H01H 9/26 200/5 B |
| 8,552,318 | B2 * | 10/2013 | Najera | H01H 9/26 200/50.35 |
| 9,105,415 | B2 * | 8/2015 | Somalingayya | H01H 9/26 |

* cited by examiner

MANUAL TRANSFER SWITCH INTERLOCK DEVICE

CROSS-REFERENCE TO RELATED APPLICATIONS

The present application claims priority under 35 U.S.C. §119 to U.S. Provisional Patent Application 61/988,026, which was filed May 2, 2014, entitled "MANUAL TRANSFER SWITCH INTERLOCK DEVICE," and is hereby incorporated by reference in its entirety into the present application.

TECHNICAL FIELD

Aspects of the present disclosure involve manual transfer switches, and, more particularly involve manual transfer switch interlock devices.

BACKGROUND

Generators are often used in certain situations to feed electrical power to residential and commercial load circuits during a utility power outage. As set forth in FIG. 1 and as understood to be conventional in power transfer devices, a portable generator 104 is typically connected to a power inlet box 106 mounted to an exterior wall of a building. The power inlet box 106 is further electrically connected to a transfer switching mechanism 108 that continues the electrical path through circuit breakers associated with the transfer switching mechanism 108 to supply power to certain selected circuits or breakers of the load circuit 110 in the main switch panel as determined by the transfer switching mechanism circuit breakers. The circuits of the transfer switching mechanism 108 are wired to selected circuits of the load center, through wiring housed within a conduit extending between the load center and the transfer switching mechanism 108. Thus, through manual operation of the switches in the transfer switching mechanism 108, a user of the system can select between utility power supplied to the load circuit through a utility meter 102 and generator power supplied by the generator 104 to power the selected circuit of the load center. As an example, during a utility power outage, a user may start up the generator 104 and manual switch the input electrical power from utility power to generator power in order to restore power to pre-designated, critical circuits (e.g., hot-water heater, refrigerator).

Typically, in the transfer switching mechanism 108, the utility power is controlled by a utility power switch and the generator power is controlled by a generator power switch. Often, the utility power switch and the generator power switch are functionally linked via an interlock device such that both switches cannot both be in the ON position at the same time, thus, preventing both the utility and the generator from simultaneously supplying power to the load center and overloading the load circuits, potentially damaging the circuits. The interlock device may physically link the utility power switch and the generator power switch such that turning one switch to the ON position forces the other switch to the OFF position. On the other hand, the interlock device may simply block both switches from being in the ON position at the same time while not aiding in the physical switching of the switches. In the case of the interlock devices physically linking the utility power switch and the generator power switch, the interlock device may cause the utility power switch and the generator power switch to act as a "break-before-make" ("BBM") switch. As the name implies, a BBM switch breaks a certain circuit before making or connecting a new circuit. In one example of an interlock device functioning as a BBM switch, as a user manually switches the generator power switch to the ON position, and, subsequently, the utility power switch to the OFF position, the interlock device breaks the circuit connection with the utility power before making a connection with the generator power. This prevents both power sources providing power to the load circuits and potentially damaging the circuits. While certain interlock devices may be known, there is room for improvement.

With these thoughts in mind, among others, aspects of the manual transfer switch interlock device, disclosed herein, were conceived.

SUMMARY

Aspects of the present disclosure involve a switch interlock device for controlling certain switching operations within a switch panel, the switch interlock device including a bracket and an interlock tripping mechanism. The bracket being configured to be coupled to a housing of the switch panel and including a face member coupled with a spanning member extending a depth of the housing, the spanning member operably coupled to a back wall of the housing. The interlock tripping mechanism being coupled to the face member of the bracket and positioned between a pair of horizontally adjacent switches housed within the housing of the switch panel, the interlock tripping mechanism configured to: restrict the pair of horizontally adjacent switches from both being in an ON position at the same time; and switch one of the pair of horizontally adjacent switches to an OFF position when the other of the pair of horizontally adjacent switches is switched to the ON position.

Aspects of the present disclosure also involve a system utilizing the switch interlock device described above and including a switch panel and at least one switch.

Aspects of the present disclosure also involve a switch interlock device for restricting certain switching operations of a pair of horizontally adjacent switches housed within a housing of a switch panel. The housing may include a back wall. The switch interlock device may include a bracket and an interlock trip member. The bracket may include a face member, a spanning member, and a flange member. The face member may be coupled with and oriented substantially perpendicularly with the spanning member. The spanning member may be coupled with and oriented substantially perpendicularly with the flange member. The face member may include at least one opening configured to receive switch handles of the horizontally adjacent switches therethrough when the bracket is installed in the switch panel. The interlock trip member may be pivotally coupled with the face member and positioned between the switch handles when the bracket is installed in the switch panel. The interlock trip member may be configured to physically block the switch handles from both being in an ON position at the same time.

BRIEF DESCRIPTION OF THE DRAWINGS

Example embodiments are illustrated in referenced figures of the drawings. It is intended that the embodiments and figures disclosed herein are to be considered illustrative rather than limiting.

DETAILED DESCRIPTION

Aspects of the present disclosure involve an interlock device for use on a manual transfer switch or other switch panel that is configured to physically restrict horizontally adjacent switches from both being in an ON position at the same time. More particularly, the interlock device restricts switch handles of horizontally adjacent switches that are functionally linked (e.g., utility power, generator power) from both being in the ON position preventing power from accidently being back fed to the "OFF" circuit and thereby providing safety against accidental electrocution. In conventional setups, a manual transfer switch may include a utility power switch having a utility power switch handle that may be manually manipulated or switched from an ON position to an OFF position in order to control the supply of utility power to a load center. The manual transfer switch may also include a generator power switch having a generator power switch handle that may be manually manipulated or switched from an ON position to an OFF position in order to control the supply of generator power to a load center. In certain arrangements, the utility power switch and the generator power switch are arranged horizontally adjacent and opposed such that the switches are in the OFF position when the switch handles point outwardly. And, the utility power switch and the generator power switch are in the ON position when the respective switch handles point inwardly, towards each other. Thus, the interlock device or a portion thereof is positioned between the horizontally adjacent switch handles to prevent an ON/ON relationship between the switches while allowing OFF/ON, ON/OFF, and OFF/OFF relationships. In addition to allowing the various relationships between the switches, the interlock device may provide a physical link between the switches so that when either switch is turned to the ON position, the other switch is forced to the OFF position, accordingly. And, as mentioned above, the interlock device may cause the switches to function as a BBM switch such that the circuits and various devices connected to the load center are not overloaded or shorted and potentially cause damage to the circuits.

Figure 1:
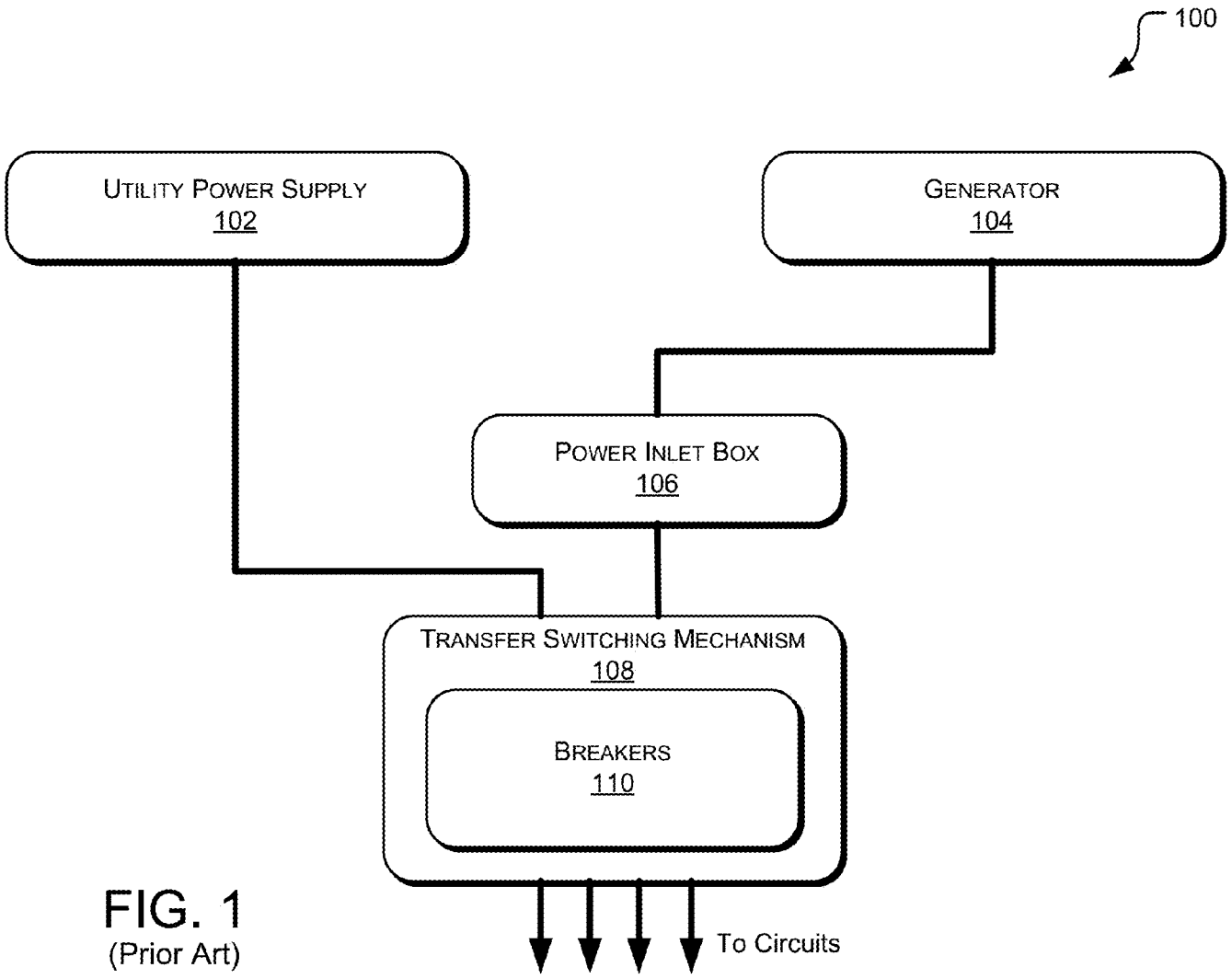
FIG. 1 (Prior Art)
FIG. 1 (prior art) depicts an isometric front view of load center with generator power supplied through a manual transfer switch and utility power supplied through a utility meter.
Figure 4:
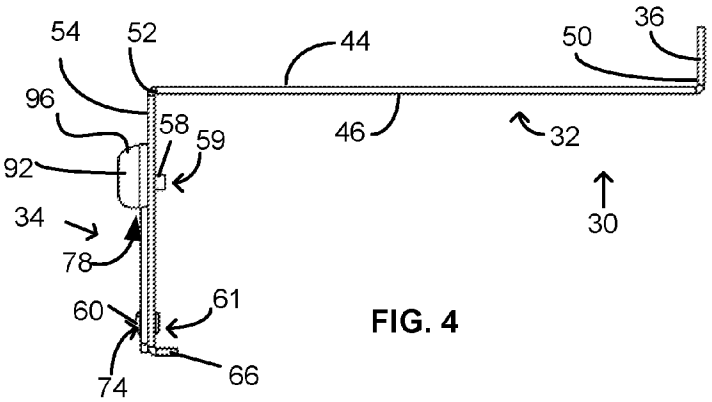
FIG. 4 depicts a side view of the first embodiment of the interlock device.
Figure 3:
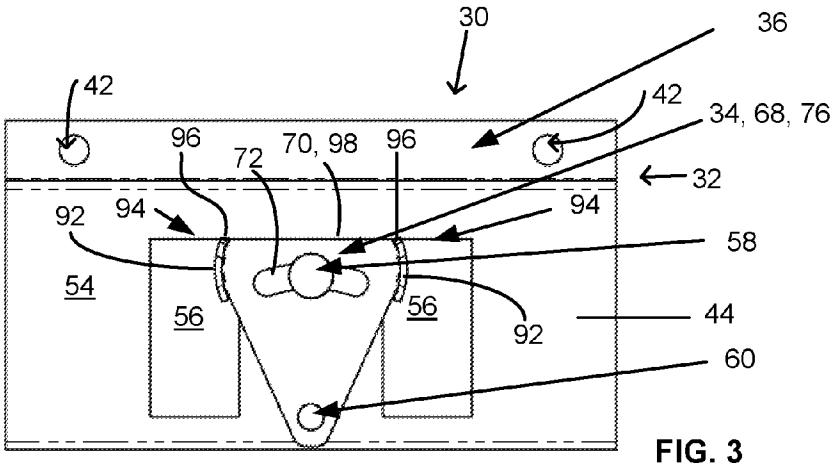
FIG. 3 depicts a front view of the first embodiment of the interlock device.
Figure 2:
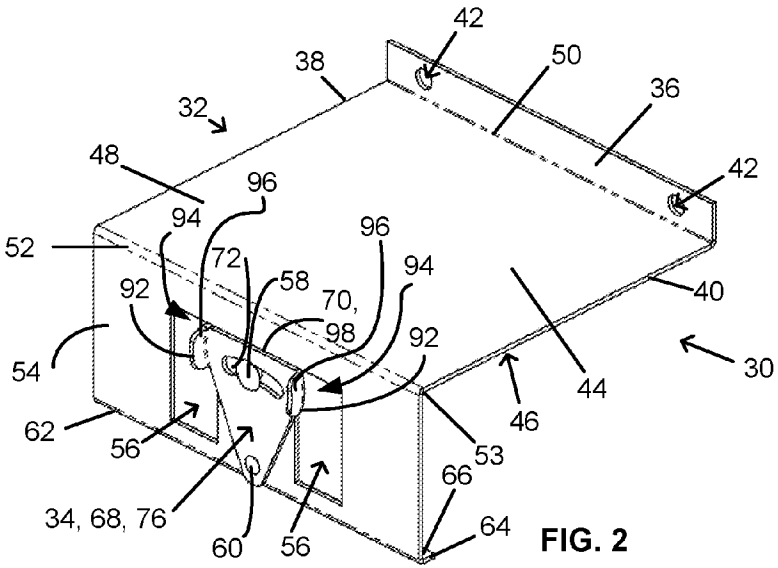
FIG. 2 depicts a front isometric view of a first embodiment of the interlock device.

Turning now to the interlock device 30 of the present disclosure, reference is made to FIGS. 2-4. Referring to FIG. 2, which is an isometric front view of a first embodiment of an interlock device 30, the device includes a hold-down bracket 32 and an interlock trip 34. The hold-down bracket 32 may be a rectangular piece of sheet metal that is bent to shape according to FIGS. 2-4. The hold-down bracket 32 includes a first flange member 36 at a rear end of the interlock device 30. The first flange member 36 is an elongated and planar member that extends from a first edge 38 to a second edge 40 of the bracket 32. In certain embodiments and as depicted in FIG. 3, the distance between the first edge 38 and the second edge 40 is about 5.2 inches. In other embodiments, the distance may be different and may be dependent on the size of a particular switch panel. The first flange member 36 includes a pair of through-holes 42 extending from a top surface 44 of the interlock device 30 to a bottom surface 46 of the interlock device 30. When installed in a manual transfer switch 16, the interlock device 30 is mounted to an inner back wall of the manual transfer switching mechanism 16 via fasteners (e.g., nuts/bolts, screws) through the through-holes 42 in the hold-down bracket 32 such that the first flange member 36 abuts the back wall of the switching mechanism 16.

Referring still to FIGS. 2-4, the first flange member 36 is connected to or transitions to a spanning member 48 along a first bend line 50, which is generally straight and provides an approximate ninety degree angular relationship between the spanning member 48 and the first flange member 36. The spanning member 48 is a planar sheet and extends from the first bend line 50 to a top front edge 52 of the hold-down bracket 32. In certain embodiments and as depicted in FIG. 4, the spanning member 48 includes a length that is about 4.5 inches from the first bend line 50 to the top front edge 52. Again, this length may be different in other embodiments and may be dependent on a depth of a particular switch panel. The top front edge 52 defines a second bend line 53 where the spanning member 48 is connected to or transitions to a face member 54 of the hold-down bracket 32. Similarly to as described with respect to the first bend line 50, the second bend line 53 provides an approximate ninety degree angular relationship between the spanning member 48 and the face member 54. The face member 54 is a planar sheet-like member that includes a pair of switch handle openings or cutouts 56 that are rectangular and that extend from the top surface 44 to the bottom surface 46 of the hold-down bracket 32. The pair of switch handle cutouts 56 are positioned such that when installed in a manual transfer switching mechanism 16, the handles of a pair of horizontally adjacent switches will extend through the cutouts 56. The face member 54 also includes a shoulder rivet 58 positioned above a standard rivet 60, where both rivets 58, 60 are positioned in through-holes 59, 61 that are centrally aligned between the pair of switch handle cutouts 56. The rivets 58, 60 interact with the interlock trip 34, as will be discussed in detail below. The face member 54 extends from the top front edge 52 to a bottom front edge 62 and also extends from the first edge 38 to the second edge 40 of the bracket 32. The bottom front edge 62 defines a third bend line 64 that connects or transitions the face member 54 to a second flange member 66. The second flange member 66 wraps around and supports a portion of a bottom side of a switch that is secured with the device 30. The second flange member 66 is planar, approximately ninety degrees from the face member 54, and extends from the first edge 38 to the second edge 40 of the bracket 32.

As stated above, the hold-down bracket 32 is mounted to a back wall of the manual transfer switch 16 via the through-holes 42. In this way, the switches are secured from errant movement, even without a dead front installed in the manual transfer switch 16 housing. That is, when the dead front is not installed, switches that are not secured behind the hold-down bracket 32 are susceptible to jostling or dislodgement. Thus, the interlock device 30 not only restricts both power switches from being in the ON position at the same time, the device 30 also securely supports the switches within the manual transfer switch 16 housing by mounting the hold-down bracket 32 to the back wall of the manual transfer switch 16 so that the switches are securely supported in position, even when the dead front is not installed.

Moving on and still referring to FIGS. 2-4, the interlock device 30 includes the interlock trip 34, which, in certain embodiments, includes a triangular member 68 that may be made from the same, or a similar, material as the hold-down bracket 32. The triangular member 68 includes three side edges 70 that define an isosceles-shaped triangle with two equal side edges that converge at a vertex. When coupled with the hold-down bracket 32, the vertex of the triangular member 68 points downward towards the third bend line 64. The triangular member 68 also includes a front face 76 with a through-hole 74 positioned near the vertex of the triangular member 68 that extends from the front face 76 to a back face of the triangular member 68. The through-hole 74 is sized to receive the standard rivet 60 such that when the rivet is "bucked" or permanently deformed, the triangular member 68 may pivot about the through-hole 74.

The triangular member 68 additionally includes a translation slot 72 positioned opposite the through-hole 74 and extending from the front face 76 to the back face of the member 68. The translation slot 72 is arched with a semi-hemispherical arc segment with a center-point being the through-hole 74. Stated differently, the translation slot 72 is positioned such that the shoulder rivet 58 or, more particularly, the shoulder feature 78 of the shoulder rivet 58 is maintained within the translation slot 72 while the triangular member 68 pivots about the through-hole 74.

Still referring to FIGS. 2-4, the triangular member includes a pair of flanges 92 extending generally perpendicularly off of the front face 76 of the triangular member 68. More particularly, the flanges 92 extend off of the corners 94 (i.e., base angle corners) of the triangular member 68 that are opposite the vertex. Each flange 92 is positioned on the triangular member 68 such that a top edge 96 of each flange 92 is generally coextensive with a top edge 98 of the triangular member 68. From the top edge 96, the flange 92 extends downward toward the vertex of the triangular member 68. As seen in FIG. 3, the flanges 92 are rounded such that as the triangular member 68 rotates about the standard rivet 60, the flange 92 smoothly contacts the switch handle of a switch positioned through the pair of switch handle cutouts 56.

The flanges 92 on the interlock trip 34 are configured to contact the switch handles of the switches as they move from an inward facing position (i.e., ON position) to an outward facing position (i.e., OFF position), or vice versa. Conventionally, the switch handles rotate or "swing" about an arc of rotation such that the switch handles are closer to the face member 54 when in the inward and outward positions than when the switch handles are halfway between the inward and outward positions. As such, the flanges 92 can contact the switch handles as the switches move about their arcs of rotation away from the face member because the flanges 92 extend outward from the front face 76 of the triangular member in a direction that is also outward from the face member 54. The height of the flanges 92 may correlate to a distance the switch handles extend outward form the face member 54 when the switch handles are halfway positioned between the inward and outward positions.

While the interlock trip 34 is described with reference to a triangular member 68, other shapes are possible in order to accomplish the same or a similar function. For example, an oval-shaped member, T-shaped member, among other shaped-members, could be used in place of the triangular member 68 to accomplish the same function. Additionally, while the vertex of the triangular member 68 points downward, the device 30 could similarly function with the vertex of the triangular member 68 pointing upwards.

Figure 7:
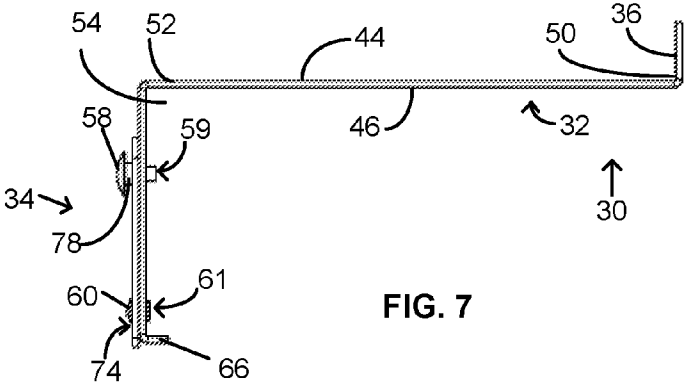
FIG. 7 depicts a side view of the second embodiment of the interlock device.
Figure 6:
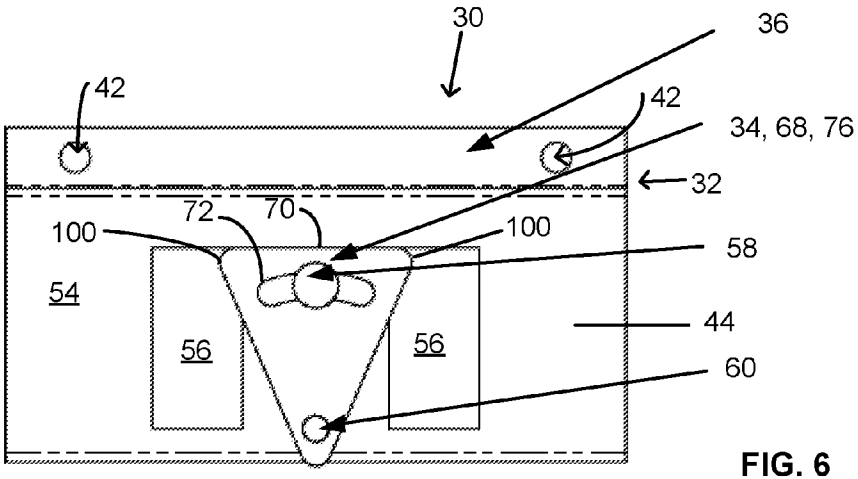
FIG. 6 depicts a front view of the second embodiment of the interlock device.
Figure 5:
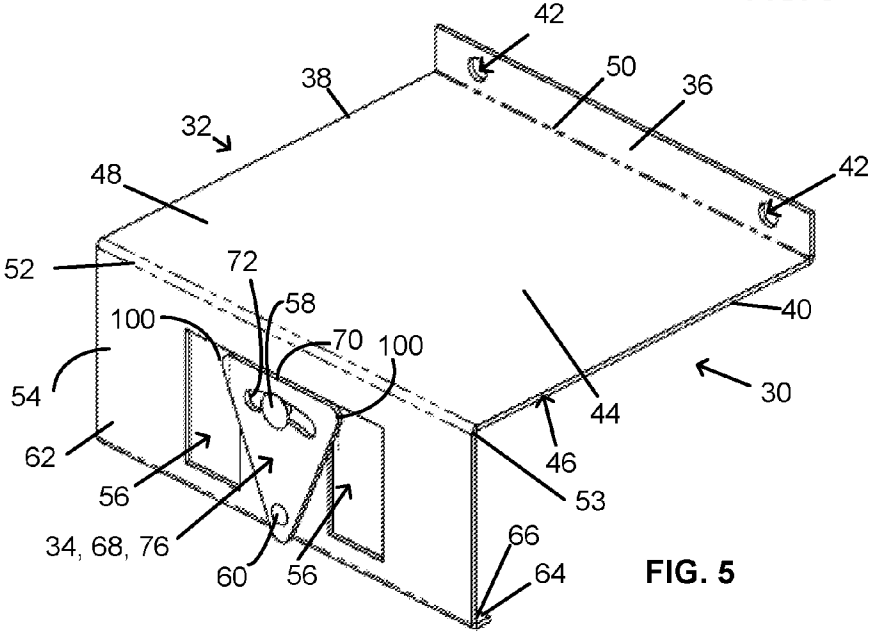
FIG. 5 depicts a front isometric view of a second embodiment of the interlock device.

Reference is now made to FIGS. 5-7, which depict various views of a second embodiment of the interlock device 30. As seen in the figures, the interlock trip 34 is the only component of the device 30 that is different from the first embodiment shown in FIGS. 2-4. That is, the features of the hold-down bracket 32 remain the same for the second embodiment shown in FIGS. 5-7.

Referring to the interlock trip 34 in FIGS. 5-7, the triangular member 68 does not include flanges on its base angle corners 100. That is, the entirety of the triangular member 68 is generally planar with no features extending off of its front face 76. Otherwise, the triangular member 68 of the second embodiment is similar to the first embodiment.

Manufacturing of the interlock device 30 may be accomplished by providing a rectangular piece of sheet metal and bending the metal along the first, second, and third bend lines 50, 54, 64 such that there is a ninety degree relationship between the first flange member 36 and the spanning member 48 and the face member 54, and the face member 54 and the second flange member 66. The switch handle cutouts 56 and through-holes 42, 59, 61 can be machined, the triangular member 68 can be positioned relative to the through-holes 59, 61, the shoulder rivet 58 can be riveted through the translation slot 72, and the standard rivet 60 can be riveted through the through-hole 74 of the triangular member 68.

Figure 9:
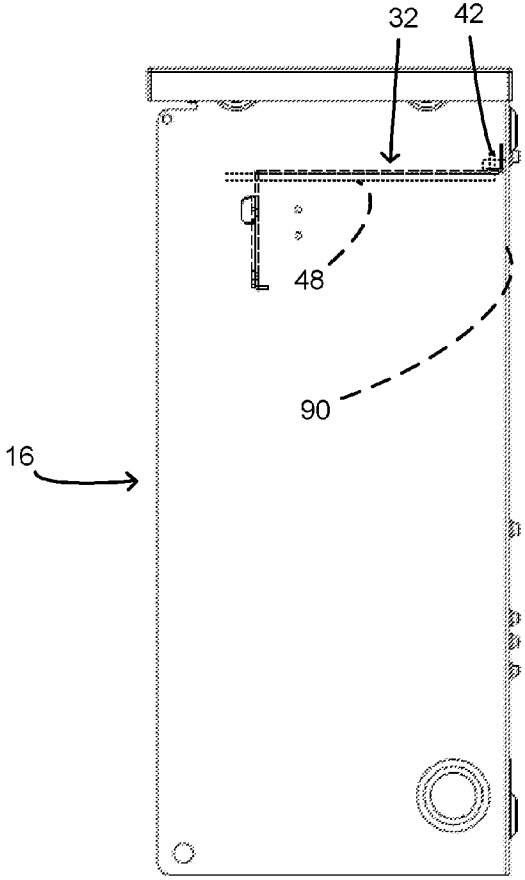
FIG. 9 depicts a side view of the manual transfer switch with a flip-up cover in a down or closed position.
Figure 8:
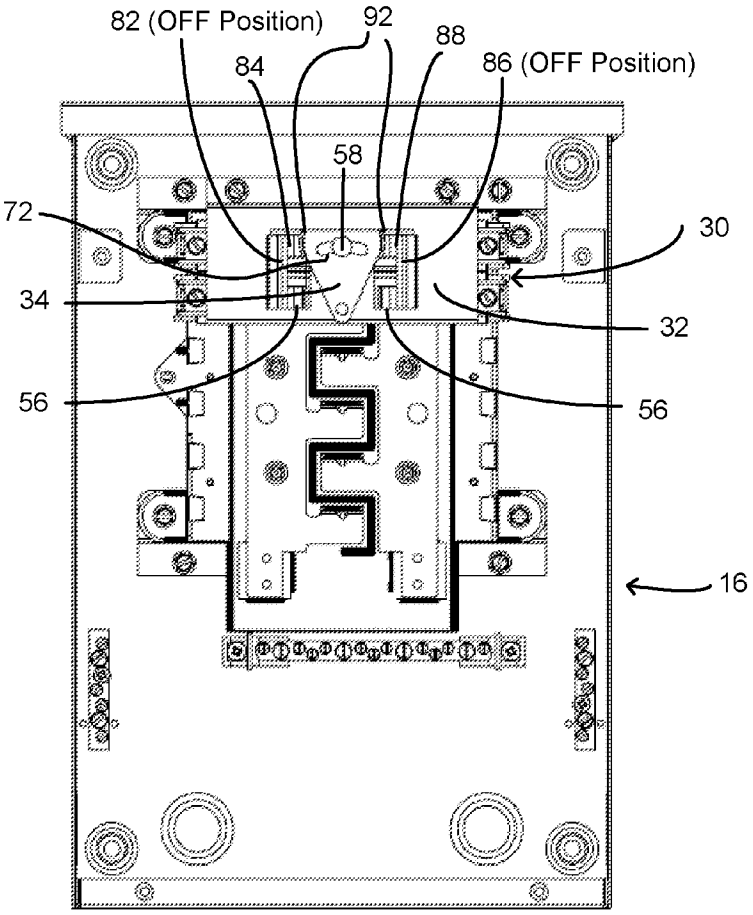
FIG. 8 depicts a front view of a manual transfer switch with the first embodiment of the interlock device installed therein and without a dead front installed.

Turning now to the interlock device 30 and its relation to a manual transfer switching mechanism 16, reference is made to FIGS. 8-9. Referring specifically to FIG. 8, which is a front view of the manual transfer switching mechanism 16 without the dead front 80 of FIGS. 10-11 installed but with the interlock device 30 installed, a utility power switch handle 82 associated with a utility power switch 84 extends through one of the switch handle cutouts 56 and a generator power switch handle 86 associated with a generator power switch 88 extends through the other switch handle cutout 56 of the interlock device 30. It is noted, the switch handles 82, 84 are oriented in the outward, OFF position. As can be seen in FIG. 9, the hold-down bracket 32 is mounted to the back wall 90 of the manual transfer switch 16 via fasteners that extend through the through-holes 42 of the bracket 32. Thus, during installation of the manual transfer switch 16 and before power is supplied to the manual transfer switch 16, the interlock device 30 can be installed. At the end of installation, the dead front 80 can be installed to cover portions of the switches or breakers that are connected to the leads, among other areas. Thus, the interlock device 30 securely supports the utility power switch 84 and the generator power switch 88 while the dead front 80 is yet to be installed, which prevents the switches 84, 88 from being dislodged at an earlier step in the installation process than if the interlock device 30 was affixed to the dead front 80. This allows a user to remove the dead front 80 to access the electrical componentry of the switches 84, 88 while preventing both switches 84, 88 from simultaneously being in the ON position and from accidental dislodgment of the switches 84, 88, which may result in an unintended and damaging electric arc in the circuit.

Referring to FIG. 8 and the interaction of the interlock trip 34 with the handles 82, 86, when both handles 82, 86 are in the OFF position, the interlock trip 34, or more particularly, the shoulder rivet 58 is centrally positioned within the translation slot 72 of the triangular member 68. In the OFF/OFF orientation, there is room or "play" such that the interlock trip has room to pivot back and forth a short distance. As, for example, the utility power switch handle 82 is manually moved inward towards the interlock trip 34, the handle 82 will contact a leg of the triangular body closest to the handle 82 which causes the interlock trip to pivot about the standard rivet 60 and the through-hole 61 such that when the handle 82 switches to the ON position, the leg of the triangular member 68 closest to the generator power switch handle 86 will be immediately adjacent the handle 86. In such an ON/OFF relationship of switch handles 82, 86 there will be decreased "play" or room for the interlock trip 34 to freely pivot without affecting the ON/OFF relationship. In order to revert to an OFF/ON relationship of switches 84, 88, the generator power switch handle 86 is manually moved inward towards the interlock trip 34 and the handle 86 contacts the leg of the triangular member closest to the handle 86 which causes the interlock trip 34 to pivot towards the utility power switch handle 82, as described previously. The leg of the triangular member 68 closest the utility power switch handle 82 contacts the handle 82 and causes the utility power switch 84 to break and disconnect the circuit just prior to the generator power switch 88 making a circuit connection. The function of breaking-before-making is accomplished due to the relatively longer travel of the switch handle to make a connection or go into the ON position, versus the relatively shorter travel of the switch handle to break a connection or go into the OFF position.

Figure 11:
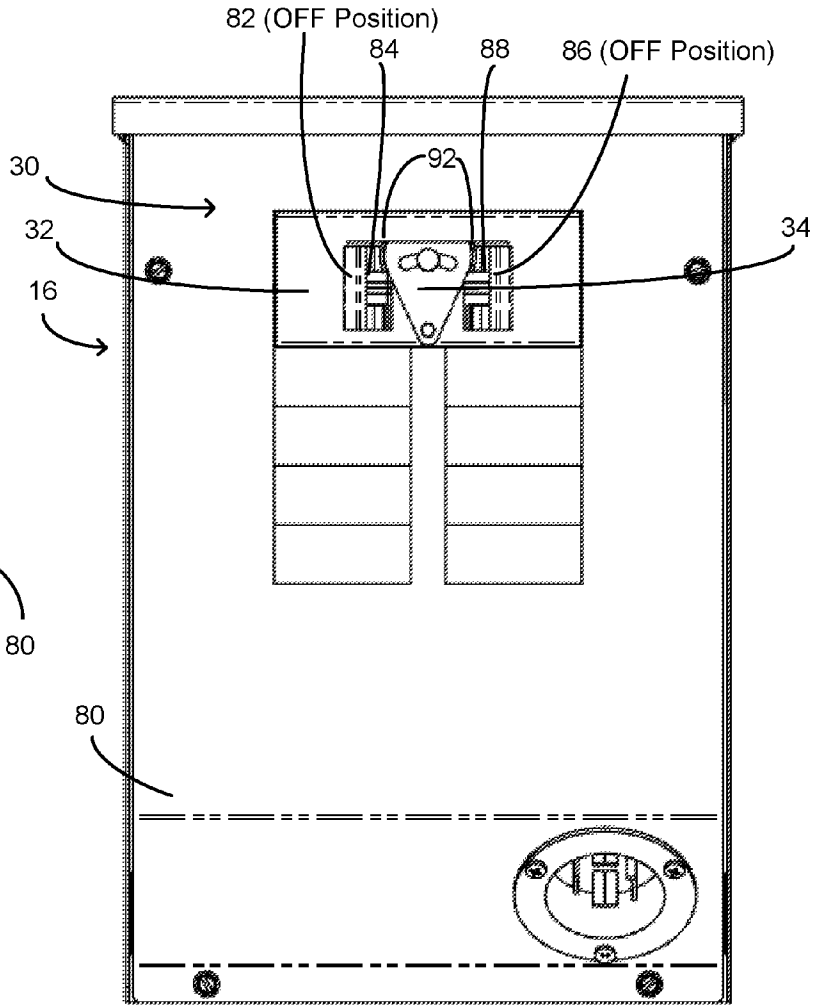
FIG. 11 depicts a front view of the manual transfer switch with the first embodiment of the interlock device installed therein and with a dead front installed.
Figure 10:
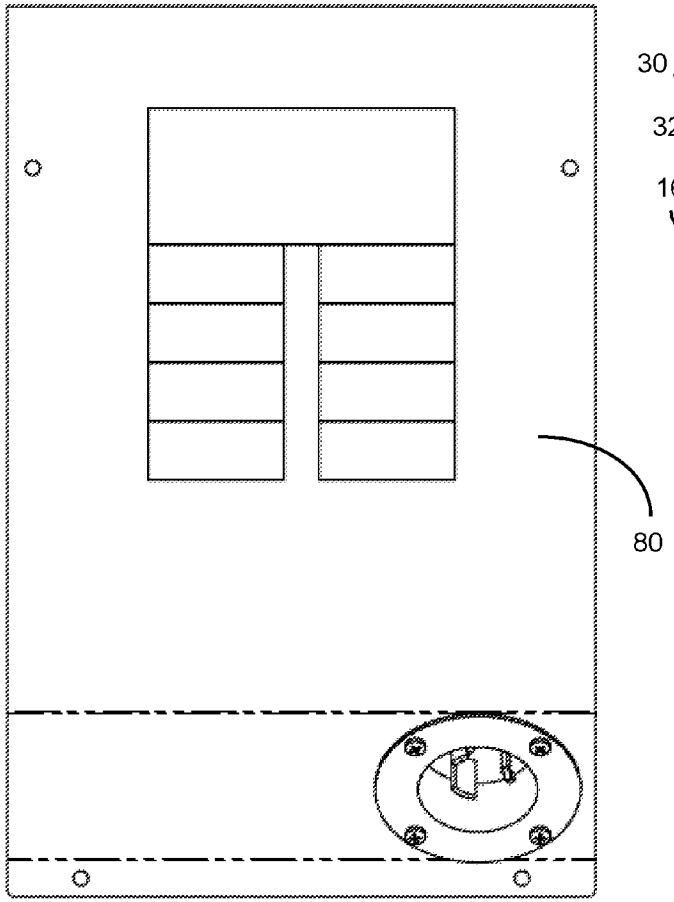
FIG. 10 depicts a front view of the dead front.

Turning now to the dead front 80 and the manual transfer switching mechanism 16 with the interlock device and the dead front 80 installed, reference is made to FIGS. 10-11. FIG. 10 depicts a front view of a dead front 80, which is a cover that is installed on the manual transfer switching mechanism 16 to shield the electrical componentry of the switches from a user that merely needs to flip switches as opposed to provide maintenance to the switches themselves. It is conventional to mount interlock-type devices to the dead front 80, but these devices do not secure the utility power switch 84 and the generator power switch 88 within the manual transfer switching mechanism 16 when the dead front 80 is removed for servicing or otherwise. Mounting the interlock device 30 to the back wall 90 ensures that the dead front 80 can be removed for servicing of additional switches, among other services, while still ensuring that neither the utility power switch 84 nor the generator power switch 88 will be accidentally dislodged causing an unintended electrical arc and damage to the circuitry. Additionally, mounting in this fashion ensures that both switches 84, 88 will not be in the ON position at the same time when the dead front 80 is not installed.

Although various representative embodiments of this invention have been described above with a certain degree of particularity, those skilled in the art could make numerous alterations to the disclosed embodiments without departing from the spirit or scope of the inventive subject matter set forth in the specification. All directional references (e.g., top, bottom, front, back) are only used for identification purposes to aid the reader's understanding of the embodiments of the present disclosure, and do not create limitations, particularly as to the position, orientation, or use of the invention unless specifically set forth in the claims. Joinder references (e.g., attached, coupled, connected, and the like) are to be construed broadly and may include intermediate members between a connection of elements and relative movement between elements. As such, joinder references do not necessarily infer that two elements are directly connected and in fixed relation to each other.

What is claimed is:

1. A switch interlock device for restricting certain switching operations of a pair of horizontally adjacent switches housed within a housing of a switch panel, the housing comprising a back wall, the switch interlock device comprising:

a bracket comprising a face member, a spanning member, and a flange member, the face member coupled with and oriented substantially perpendicularly with the spanning member, the spanning member coupled with and oriented substantially perpendicularly with the flange member, the flange member coupled to the back wall of the housing, the face member comprising at least one opening configured to receive switch handles of the horizontally adjacent switches therethrough when the bracket is installed in the switch panel; and an interlock trip member pivotally coupled with the face member and positioned between the switch handles when the bracket is installed in the switch panel, the interlock trip member being configured to physically block the switch handles from both being in an ON position at the same time, wherein the interlock trip member comprising a triangular member that is pivotally coupled with the face member near a vertex of the triangular member, the triangular member comprising a translation slot configured to limit a degree of pivoting of the triangular member relative to the face member.

2. The switch interlock device of claim 1, wherein the at least one opening is a pair of openings, each of the pair of openings configured to receive a switch handle of the switch handles.

3. The switch interlock device of claim 1, wherein the pair of horizontally adjacent switches are secured from removal when a dead plate is uninstalled.

4. The switch interlock device of claim 1, wherein the triangular member includes a pair of flanges extending off of a front face of the triangular member.

5. The switch interlock device of claim 4, wherein each of the pair of flanges is positioned near a base angle corner of the triangular member.

6. A switch interlock device for controlling certain switching operations of a pair of horizontally adjacent switches housed within a housing of a switch panel, the switch interlock device comprising:

a bracket configured to be coupled to the housing of the switch panel and comprising a face member coupled with a spanning member extending a depth of the housing, the spanning member configured to couple to a back wall of the housing, the face member comprising a pair of openings extending through the bracket, each of the pair of openings being configured to receive a switch handle associated with one of the pair of horizontally adjacent switches; and an interlock tripping mechanism coupled to the face member of the bracket and positioned between the pair of horizontally adjacent switches housed within the housing of the switch panel, the interlock tripping mechanism comprising a triangular member that is pivotally coupled to the face member and positioned in between the pair of openings, the triangular member comprising a vertex and pivots at a pivot point near the vertex, wherein the triangular member further comprises a translation slot opposite of the pivot point that is configured to restrict the amount of pivoting of the interlock tripping mechanism, the interlock tripping mechanism configured to: restrict the pair of horizontally adjacent switches from both being in an ON position at the same time; and switch one of the pair of horizontally adjacent switches to an OFF position when the other of the pair of horizontally adjacent switches is switched to the ON position.

7. The switch interlock device of claim 6, wherein the triangular member comprises a pair of leg edges extending on each side of the vertex, each of the pair of leg edges configured to contact one of the pair of horizontally adjacent switches when the horizontally adjacent switches are switched between the OFF position and the ON position.

8. The switch interlock device of claim 6, wherein the interlock tripping mechanism both pivots and translates when the horizontally adjacent switches switch between the OFF and the ON position.

9. The switch interlock device of claim 6, wherein the bracket supports the pair of horizontally adjacent switches in place within the switch panel such that the bracket must be removed in order to remove the pair of horizontally adjacent switches.

10. The switch interlock device of claim 6, wherein the bracket supports the pair of switches in place within the switch panel when a dead plate is uninstalled in the switch panel such that the bracket must be removed in order to remove the pair of horizontally adjacent switches.

11. The switch interlock device of claim 6, wherein the face member is substantially perpendicular to the spanning member.

12. The switch interlock device of claim 6, wherein the back wall is an inner back wall of the switch panel.

13. The switch interlock device of claim 6, wherein the bracket further comprises:

a first flange member coupled to the spanning member at about a perpendicular connection, the first flange member being coupled to an inner back wall of the switch panel;

the face member comprising a pair of openings extending through the bracket, each of the pair of openings being configured to receive a switch handle associated with one of the pair of horizontally adjacent switches; and the spanning member extending substantially perpendicularly between the first flange member and the face member.

14. The switch interlock device 6, wherein the triangular member includes a pair of flanges extending off of a front face of the triangular member.

15. The switch interlock device of claim 14, wherein each of the pair of flanges is positioned near a base angle corner of the triangular member.

16. A system comprising the interlock device of claim 6, the system further comprising:

the switch panel comprising the housing.

17. The system of claim 16, further comprising at least one switch.

18. The system of claim 16, further comprising the pair of horizontally adjacent switches.

* * * * *